US011441408B2

(12) United States Patent
Blinderman et al.

(10) Patent No.: US 11,441,408 B2
(45) Date of Patent: Sep. 13, 2022

(54) UNDERGROUND COAL GASIFICATION AND ASSOCIATED SYSTEMS AND METHODS

(71) Applicant: Ergo Exergy Technologies Inc., Montreal (CA)

(72) Inventors: Mikhail Blinderman, Montreal (CA); Ivan Saptykov, Montreal (CA); Semyon Maev, Calgary (CA); Brett Eugene Wilcox, Portland, OR (US)

(73) Assignee: Ergo Exergy Technologies Inc., Montreal (CA)

( * ) Notice: Subject to any disclaimer, the term of this patent is extended or adjusted under 35 U.S.C. 154(b) by 0 days.

(21) Appl. No.: 17/456,130

(22) Filed: Nov. 22, 2021

(65) Prior Publication Data

US 2022/0228471 A1 Jul. 21, 2022

Related U.S. Application Data

(63) Continuation of application No. 17/468,649, filed on Sep. 7, 2021, which is a continuation of application (Continued)

(51) Int. Cl.
*E21B 43/295* (2006.01)
*E21B 43/243* (2006.01)
*E21B 43/00* (2006.01)

(52) U.S. Cl.
CPC ..... *E21B 43/295* (2013.01); *E21B 43/006* (2013.01); *E21B 43/243* (2013.01)

(58) Field of Classification Search
CPC ..... E21B 43/006; E21B 43/243; E21B 43/30
See application file for complete search history.

(56) References Cited

U.S. PATENT DOCUMENTS 2,718,263 A * 9/1955 Heilman ..... E21B 43/40 166/266
4,399,866 A 8/1983 Dearth
(Continued)

FOREIGN PATENT DOCUMENTS

EP 2787164 A1 10/2014

OTHER PUBLICATIONS

International Search Authority, "International Search Report and the Written Opinion" for PCT Application No. PCT/US2021/040931, dated Nov. 10, 2021, 16 pages.

*Primary Examiner* — Giovanna Wright
(74) *Attorney, Agent, or Firm* — Perkins Coie LLP

(57) ABSTRACT

Methods and systems for gasifying coal are disclosed herein. In some embodiments, a representative coal gasification system can comprise (i) an injection well extending from a ground surface to an underground coal gasification (UCG) reaction region of a coal seam; (ii) a production well spaced apart from the injection well and extending from the ground surface to the UCG reaction region, and (iii) conduits each extending from the ground surface to areas of the coal seam. End portions of the conduits within the coal can be laterally peripheral to the UCG reaction region. The conduits are configured to deliver a primary fluid from the ground surface to the primary region, the injection well is configured to deliver an oxidant gas to the UCG reaction region, and the production well is configured to deliver the product gas from the UCG reaction region to the ground surface.

28 Claims, 3 Drawing Sheets

Related U.S. Application Data

No. 17/200,334, filed on Mar. 12, 2021, now Pat. No. 11,125,069.

(60) Provisional application No. 63/139,044, filed on Jan. 19, 2021.

(56) References Cited

U.S. PATENT DOCUMENTS

| | | | | |
|---|---|---|---|---|
| 4,483,398 | A * | 11/1984 | Peters | E21B 43/247 166/259 |
| 9,016,370 | B2 * | 4/2015 | Daub | E21B 36/04 166/302 |
| 11,125,069 | B1 * | 9/2021 | Blinderman | E21B 43/243 |
| 2009/0145843 | A1 | 6/2009 | Ahner | |
| 2014/0305640 | A1 | 10/2014 | Wellington et al. | |

* cited by examiner

UNDERGROUND COAL GASIFICATION AND ASSOCIATED SYSTEMS AND METHODS

CROSS-REFERENCE TO RELATED APPLICATION(S)

The present application is a continuation application of U.S. patent application Ser. No. 17/468,649, filed Sep. 7, 2021, which is a continuation of U.S. patent application Ser. No. 17/200,334, filed Mar. 12, 2021, now U.S. Pat. No. 11,125,069, which claims the benefit of priority to U.S. Provisional Patent Application No. 63/139,044, filed Jan. 19, 2021, the disclosures of which are incorporated herein by reference in their entireties.

TECHNICAL FIELD

The present disclosure relates to the field of underground coal gasification.

BACKGROUND

Underground coal gasification ("UCG") is an industrial process in which coal is used to generate a product gas at an underground coal seam. Generally, UCG involves supplying an oxidant and, if required, water and/or steam to an underground coal seam in order to ignite coal and sustain the gasification process. The oxidant and possibly other reagents are typically delivered to the underground coal seam via injection wells drilled from the surface. The gasification process generates product gases, which can then be brought to the surface using production wells drilled from the surface. The predominant product gases are hydrogen, carbon monoxide, methane and carbon dioxide. Alternatively, mined shafts and associated workings can be used to inject the oxidant and/or produce the product gas. The resultant extracted product gas may be commercially used in a number of ways, e.g., as combustion fuel for power generation, or as a chemical feedstock in the production of fuels, fertilizers, or other chemical products.

BRIEF DESCRIPTION OF THE DRAWINGS

Embodiments of the present disclosure will be described with reference to the appended drawings. However, various embodiments of the present disclosure are not limited to arrangements shown in the drawings.

DETAILED DESCRIPTION

I. Overview

Figure 1:
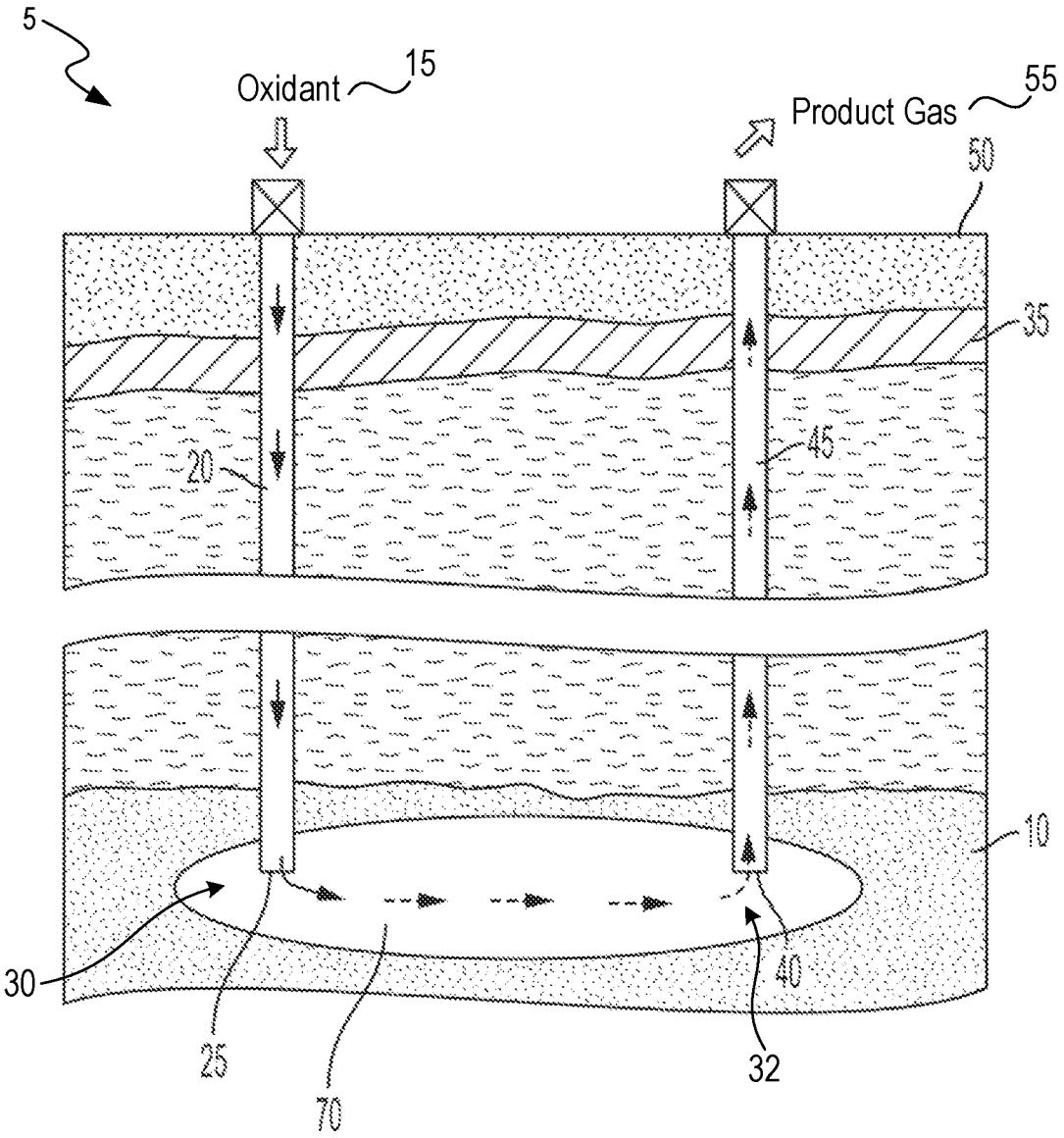
FIG. 1 (PRIOR ART)
FIG. 1 is a schematic cross-sectional side view of an underground coal gasification system.

As described above, underground coal gasification ("UCG") is a process in which one or more oxidants are injected into a coal seam to promote an in-situ gasification reaction. The gasification reaction produces a product gas, which can then be extracted and brought to the surface using one or more production wells extending from the coal seam to the surface. The product gases can comprise hydrogen, carbon monoxide, methane and/or carbon dioxide, and are sometimes referred to as "syngas" or synthesis gas. The specific composition of the product gas can vary based on a number of factors, such as formation pressure, depth of the coal seam, oxidant balance, and gasification conditions.

While UCG and other underground gas processing technologies have been used for decades to produce and extract syngas, the conventional UCG systems and methods have a number of deficiencies. For example, the UCG system typically includes an injection well and a production well that each have end portions disposed within a UCG reaction region of the coal seam at which the gasification reaction occurs. As the oxidant gas is injected via the injection well and the coal of the coal seam at the UCG reaction region is ignited, the injected oxidant gas reacts with carbon molecules of the coal to produce syngas. However, when the oxidant gas disperses from the injection well within the coal seam, there is no containment device outside the UCG reaction region or technique to prevent the oxidant gas from traveling in a direction away from the production well. As a result, not all of the oxidant gas is used by the gasification reaction and converted into syngas, and some of the oxidant gas can oxidize areas of the coal seam surrounding the UCG reaction region, which is generally undesirable. This in turn can cause low product gas yield, low hydrogen recovery, and increased costs for the operator. Relatedly, much of the product gas produced by the gasification reaction is not extracted by the production well for the same reason. That is, as the product gas is generated within the UCG reaction region, the product gas disperses in directions away from the production well, and thus not all of the product gas is extracted. This further contributes to the low yield, low hydrogen recovery, and increased costs. Additionally, the unextracted product gas can migrate to other regions of the coal seam and act as a contaminant.

Embodiments of the present technology address these and other issues by containing the oxidant gas, product gas, and/or other gases in the UCG reaction region, thereby inhibiting them from migrating to undesired areas. As an example, embodiments of the present technology can include an injection well extending from the ground surface to the UCG reaction region of the coal seam, a production well extending from the ground surface to the UCG reaction region, and a plurality of conduits each extending from the ground surface to areas of the coal seam that are laterally peripheral to the UCG reaction region. In some embodiments, end portions of the conduits are positioned in the coal seam to form a perimeter or a partial perimeter around the UCG reaction region, such that a primary fluid delivered via the conduits can form a pressurized primary region within the coal seam that at least partially surrounds the UCG reaction region. The primary region can effectively act as a barrier and/or operate at a pressure higher than that of the UCG reaction region to contain the gases associated with the gasification reaction. In doing so, embodiments of the present technology can better ensure (i) the oxidant gas is used by the gasification reaction occurring within the UCG reaction region, and/or (ii) the product gases are extracted via the production well to increase yield of the product gas and enhance hydrogen recovery, amongst other benefits.

FIG. 1 illustrates a UCG system 5 and associated process. As shown in FIG. 1, the UCG system 5 includes an underground coal seam 10 having a UCG reaction region 70, an injection well 20 extending from a surface 50 to the UCG reaction region 70, and a production well 45 extending from the UCG reaction area 70 to the surface 50. The coal seam 10 and/or UCG reaction region 70 is located a distance (e.g., 100 meters (m)-1600 m) below the ground surface 50, and is the site at which the in-situ gasification reaction occurs. The injection well 20 can be configured to receive an oxidant (e.g., oxygen, air, or combinations thereof) and deliver it to the UCG reaction region 70, and the production well 45 can be configured to receive a product gas 55 (e.g., syngas) produced at the UCG reaction region 70 and deliver the product gas 55 to the surface 50, where the product gas 55 can undergo further processing. An end portion 25 of the injection well 20 can be positioned at a reaction region 30 of the UCG reaction area 70, and an end portion 40 of the production well 45 can be positioned at a production region 32 of the UCG reaction area 70. The distance between the end portion 25 of the injection well 20 and the end portion 40 of the production well 45 can be between 15-300 m, and can vary depending on various factors of the particular UCG reaction region 70.

The oxidant 15 can be supplied (e.g., pumped) from the surface 50 at a generally high pressure and/or ambient (or higher) temperature. In some embodiments, the oxidant 15 can have a temperature of from 700° C.-1500° C. or any value therebetween (e.g., 800° C., 900° C., 1000° C., 1200° C., 1400° C., etc.) at the UCG reaction region 70 over the course of the gasification reaction. In some embodiments, water may also be supplied via the injection well, e.g., in conjunction with the oxidant 15, and can enable the gasification reaction to produce more product gas 55. In some embodiments, the coal seam 10 includes sufficient water, e.g., because it is located beneath a water table 35, and thus additional water does not need to be supplied via the injection well 20. In operation, the coal of the coal seam 10 is ignited and the gasification reaction is initiated, enabling the injected oxidant 15 and/or water to promote the in-situ gasification reaction and produce the product gas 55.

As previously described, the product gas 55 can comprise a mixture of hydrogen, carbon monoxide, methane and carbon dioxide. In some embodiments, the product gas 55 can also comprise contaminants including various organic compounds, ammonia, and hydrogen sulfide. The product gas 55 is represented in simplified terms in Reaction 1 below as just hydrogen and carbon monoxide.

$$3C(s)+H_2O(g)+O_2(g)\rightarrow 3CO(g)+H_2(g) \quad \text{(Reaction 1)}$$

In practice, the product gas 55 produced via the gasification reaction flows toward the production region 32 and then to the surface 50 via the production well 45. The extracted product gas 55 may then be treated (e.g., purified) and/or undergo further processing depending on the desired end use or commercial application.

II. Underground Coal Gasification System and Associated Methods

Figure 2:
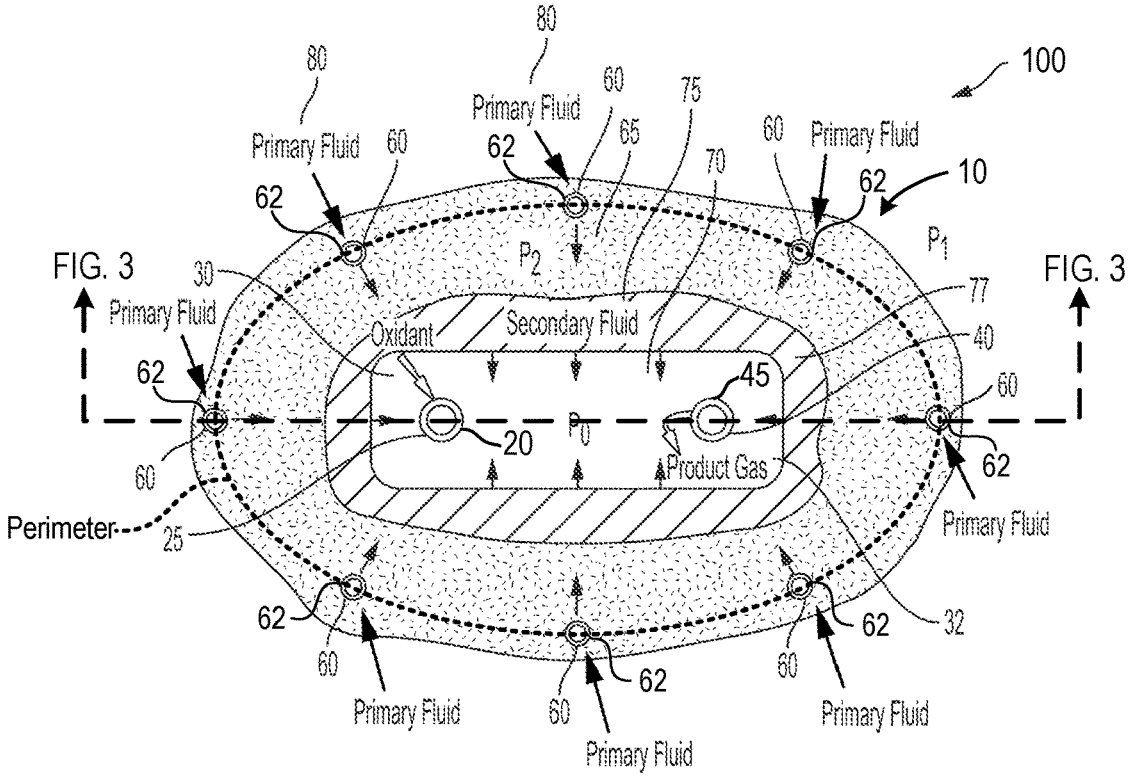
FIG. 2 is a schematic cross-sectional plan view of an underground coal gasification system, in accordance with embodiments of the present technology.
Figure 3:
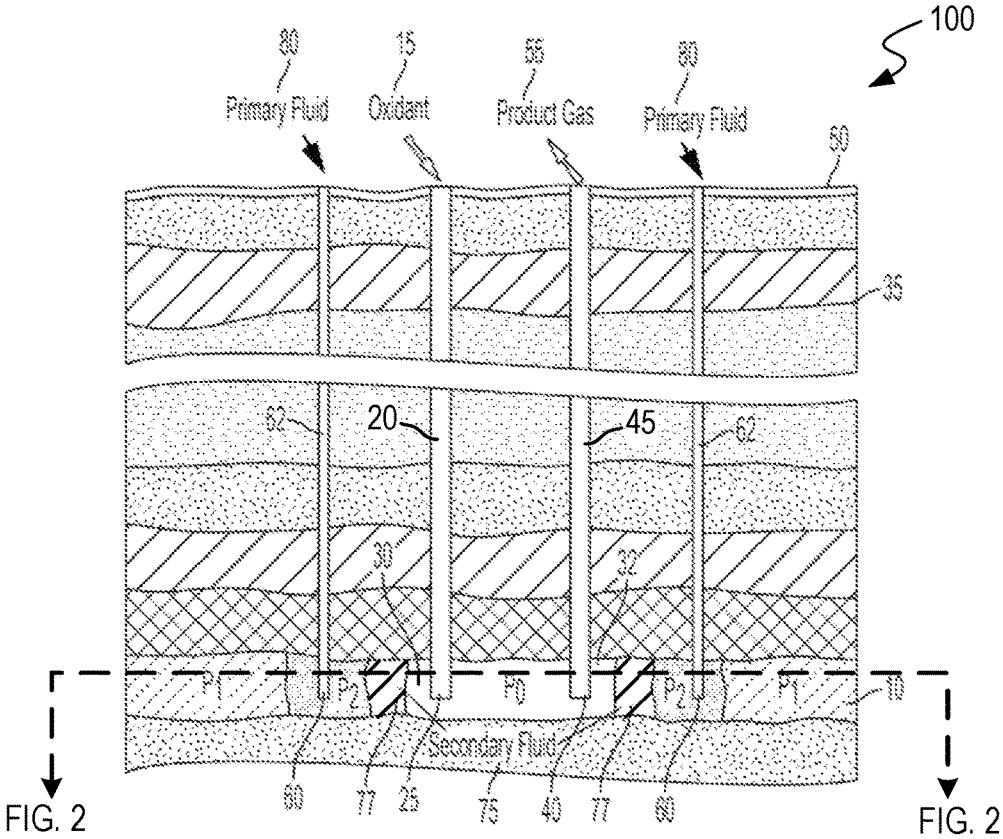
FIG. 3 is schematic cross-sectional side view of the underground coal gasification system shown in FIG. 2.

As previously described, embodiments of the present technology include improvements to conventional UCG systems. FIG. 2 is a schematic cross-sectional plan view of a representative UCG system 100, and FIG. 3 is a schematic cross-sectional side view of the UCG system 100 shown in FIG. 2. Referring to FIGS. 2 and 3 together, the system 100 includes the injection well 20 and the production well 45, each extending from the ground surface 50 (FIG. 3) to the coal seam 10, with the end portions 25, 40 (FIG. 3) of the respective injection well 20 and production well 45 being positioned in or at the UCG reaction region 70 of the coal seam 10. As described with reference to FIG. 1, the injection well 20 is configured to deliver the oxidant 15 to the coal seam 10 and the production well 45 is configured to deliver product gas 55 produced at the UCG reaction region 70 to the ground surface 50 (FIG. 3).

With continuing reference to FIGS. 2 and 3, the system 100 can include a plurality of fluid conduits 62 (e.g., wells, mining shafts, etc.). Each of the conduits 62 can extend from the ground surface 50 (FIG. 3) to an area of the coal seam 10, and have end portions 60 positioned laterally peripheral to (i) the UCG reaction region 70 and/or (ii) end portions 25, 40 (FIG. 3) of the respective injection well 20 and production well 45. As shown in FIG. 2, the end portions 60 of the conduits 62 can surround the end portions 25, 40 of the respective injection well 20 and production well 45, such that the conduit end portions 60 form a perimeter around the well end portions 25, 40 and/or the UCG reaction area. In some embodiments, the conduit end portions 60 can be arranged within the coal seam 10 to form a generally circular, ovular, rectangular, or polygonal shape. Additionally or alternatively, in some embodiments the conduit end portions 60 do not entirely surround the end portions 25, 40 of the respective injection well 20 and production well 45, but rather only partially surround the well end portions 25, 40.

The conduits 62 can be configured to receive a primary fluid 80 and deliver the primary fluid 80 from the ground surface 50 to the coal seam 10 via the conduit end portions 60. The primary fluid 80 can comprise carbon dioxide (e.g., gaseous or liquid carbon dioxide), a supercritical fluid (e.g., supercritical carbon dioxide), water (e.g., steam), organic materials (e.g., organic solvents, polymers), inorganic materials, and/or combinations thereof. Once injected, the primary fluid 80 can disperse from each of the conduit end portions 60 into the coal seam 10 to generally saturate a surrounding area and form a primary region 65. The primary region 65 comprises the coal or coal matrix of the coal seam 10 and the primary fluid 80, in which the primary fluid 80 can comprise (i) at least 30%, 40%, 50%, 60%, 70%, or 80% by volume of the open fracture space and/or pore volume of the primary region 65, and/or (ii) at least 5%, 10%, 15%, 20%, 25% by weight of the primary region 65 (e.g., via adsorption to the coal and filling the pore and open fracture space). As such, the primary fluid 80 injected to the coal seam 10 via individual ones of the conduits 62 will disperse from the corresponding conduit end portions 60 in multiple directions, such that the primary region 65 forms around the conduit end portions 60 of each of the conduits 62. Injecting the primary fluid 80 can cause (i) the coal, or coal matrix of the coal seam to increase in size, (ii) closure of cleat fractures of the coal seam 10, and/or (ii) voids or pore space between individual coal particles of the coal seam 10 to be filled. Stated differently, whereas the coal seam 10 can have a first void or pore space between individual coal particles prior to the primary fluid 80 being injected, the primary region 65 can have a second pore space that is less than the first pore space after injecting the primary fluid 80.

The primary region 65 formed as a result of injecting the primary fluid 80 around the UCG reaction region 70 can effectively contain the oxidant 15, product gas 55, and other gases present within the UCG reaction region 70. Stated differently, the primary region 65 can create a low permeability or generally impermeable jacket or barrier zone that inhibits the migration of fluids from the UCG reaction region 70 to areas of the coal seam 10 peripheral to the primary region 65. In doing so, the primary region 65 can improve the overall yield of the product gas 55 produced via the system 100, improve conversion of the oxidant 15, enhance hydrogen recovery, and/or improve the quality of the product gas 55, amongst other benefits. As an example, in an actual trial wherein water was injected into a coal seam surrounding a UCG reaction region, hydrogen content of the product gas increased from 10-15% to 18-26% on a mol/mol basis.

Injecting the primary fluid 80 and/or the oxidant 15 can occur at predetermined pressures, e.g., to create a pressure differential between the UCG reaction region 70, the primary region 65, and/or the surrounding coal seam 10. In some embodiments, the primary fluid 80 is injected at a pressure of at least 100 bar, 110 bar, 120 bar, 130 bar, 140 bar, 150 bar, or 160 bar, or within a range of 100-160 bar or any incremental range therebetween (e.g., 145-155 bar). In some embodiments, the injection pressure of the primary fluid 80 is controlled using compressors, pumps, or other regulating equipment located at the ground surface 50 (FIG. 3). Additionally or alternatively, in some embodiments the injection pressure is controlled based on the product gas 55 (e.g., the flow rate and/or composition of the product gas 55 received via the production well 45). The pressure at which the primary fluid 80 is injected can be generally above or equal to the pressure ($P_2$) of the primary region 65. In some embodiments, the oxidant 15 is injected at a pressure of no more than 50 bar, 60 bar, 70 bar, or 80 bar, or within a range of 50-80 bar or any incremental range therebetween. The pressure at which the oxidant 15 is injected can be generally above or equal to the pressure ($P_0$) of the UCG reaction region 70. For example, the pressure of the oxidant 15 at the well end portion 25 is less than the injection pressure at the top of the injection well 20 due to hydraulic resistance of the injection well 20. As such, the pressure ($P_2$) of the primary region 65 is higher than the pressure ($P_0$) of the UCG reaction region 70. A hydrostatic reservoir pressure ($P_1$) of untreated areas of the coal seam 10 can vary, but in some embodiments can be about 140 bar, 150 bar, or 160 bar, or within a range of 140-160 bar or any incremental range therebetween. The hydrostatic pressure ($P_1$) is always higher than the pressure ($P_0$) of the UCG reaction region 70. The pressures of the coal seam 10, primary region 65, and UCG reaction region 70 create a pressure profile in which the oxidant 15, product gas 55, and other gases present within the UCG reaction region 70 are contained within and/or inhibited from migrating laterally beyond the primary region 65. As a result, these gases are more effectively utilized as reactants and/or extracted via the production well 45.

In some embodiments, the injection pressure of the primary fluid 80 and/or the injection pressure of the oxidant 15 (and therein the pressure ($P_0$) of the UCG reaction region 70) is based on the depth of the coal seam 10, which in turn determines the hydrostatic pressure ($P_1$) of the coal seam 10. For example, the pressure ($P_0$) of the UCG reaction region 70 (e.g., the gasification pressure) is a value between the injection pressure of the oxidant 15 and the production pressure at which the product gas 55 is extracted via the production well 45. The injection pressure of the primary fluid 80, and/or the pressure ($P_2$) of the primary region 65, is higher than the hydrostatic pressure ($P_1$) of the coal seam 10, which in turn is higher than the pressure ($P_0$) of the UCG reaction region 70, e.g., to maintain a hydraulic pressure gradient of fluids in the system 100 and direct the oxidant 15 and/or product gas 55 toward the UCG reaction region 70. The injection pressure of the primary fluid 80 and/or the pressure ($P_2$) of the primary region 65 is set to be above the hydrostatic pressure ($P_1$) to ensure the primary fluid 80 flows into the coal seam 10 (e.g., the pore volume and/or fractures of the coal seam). The system 100 can include one or more sensors within the coal seam 10 that are configured to measure pressures of the UCG reaction region 70, primary region 65, and/or coal seam 10.

In some embodiments, the primary fluid 80 is injected to the injection well 20 at a flow rate that is proportional to the pressure differential between the primary region 65 and the coal seam 10 (e.g., between the primary region pressure ($P_2$) and the hydrostatic pressure ($P_1$)). In operation, it can be beneficial to set a flow rate of the primary fluid 80 that maintains a minimum pressure differential (e.g., 10 bar, 15 bar, 20 bar, 30 bar, 40 bar, 50 bar, 75 bar, 100 bar, etc.) between the primary region 65 and the coal seam 10, while also keeping the injection pressure of the primary fluid 80 and/or the pressure ($P_0$) of the UCG reaction region 70 relatively low to minimize compression costs. Additionally or alternatively, in some embodiments the injection pressure of the primary fluid 80 is set to be a predetermined percentage (e.g., 10%, 15%, 20%, or 25%) above the hydrostatic pressure ($P_1$). In some embodiments, the injection pressure of the primary fluid is between and/or based on the hydrostatic pressure ($P_1$) and a lithostatic pressure (e.g., pressure imposed by the weight of overlying material) of the coal seam at the depth of the UCG reaction region. In such embodiments, the lithostatic pressure can be at least 300 bar, 350 bar, 400 bar, etc.

As previously described, injecting the primary fluid 80 into the coal seam 10 can cause the corresponding coal to increase in size (e.g., swell). Without being bound by theory, this increase in size can be due to the higher affinity of the coal for the primary fluid 80 (e.g., carbon dioxide) relative to other fluids (e.g., water and/or methane) commonly present in the coal seam 10. For example, the higher affinity for the primary fluid 80 can cause the carbon dioxide and/or other constituents of the primary fluid 80 to attach or adsorb to the coal, and thereby cause the coal to swell. As a result of such swelling, the relative pore space between the adjacent coal particles of the coal seam 10 is advantageously decreased and allows the primary region 65 to effectively act as a barrier to prevent or inhibit gases and fluids (e.g., the oxidant gas 15, water, methane, hydrocarbons, carbon monoxide, carbon dioxide, and hydrogen) present in the UCG reaction region 70 from migrating beyond (e.g., laterally peripheral to) the primary region 65. In doing so, a greater amount of these gases remains available to react within and/or be extracted from the UCG reaction region 70, and can thus (i) increase production of the product gas 55, (ii) enhance hydrogen recovery, and/or (iii) improve effectiveness of the system 100 generally.

The type of primary fluid 80 injected into the coal seam 10 can affect certain characteristics of the primary region 65 and produce different benefits. For example, in those embodiments for which the primary fluid 80 comprises carbon dioxide, injecting the primary fluid 80 can cause the coal matrix of the coal seam 10 to swell, as previously described, and form a sequestration cap or barrier around the UCG reaction region 70. The sequestration cap can help contain the spread of groundwater in the coal seam region and thereby have one or more environmental benefits in addition to the production benefit(s) previously described. The sequestration cap can remain in place as a barrier for extensive periods of time (e.g., months, years, or decades), depending on the hydrostatic pressure ($P_1$) of an untreated area of that particular coal seam 10, and/or the pressure differential between the hydrostatic pressure ($P_1$) and the pressure ($P_2$) of the primary region 65 and/or sequestration cap. Stated differently, as long as there is groundwater saturation of the surrounding coal seam 10 and the hydrostatic pressure ($P_1$) remains constant, the carbon dioxide will not desorb from coal and will continue to be stored at the same quantity. If the hydrostatic pressure decreases with time, carbon dioxide will partially desorb and continue to be stored in equilibrium with the hydrostatic pressure ($P_1$). Since the hydrostatic pressure ($P_1$) in deep coal seams tends to stay constant, and once disturbed by UCG operations tends to restore its original values with time, carbon can be stored in the coal seam 10 for an indefinite time. Additionally or alternatively, in such embodiments for which the primary fluid 80 comprises carbon dioxide, the carbon dioxide can react with (e.g., be reduced by) coal present in the UCG reaction region 70 to form carbon monoxide, as represented in Reaction 2 below. Additionally, carbon monoxide can further react with water vapor present in the UCG reaction region 70 according to the water-gas shift reaction, as represented in Reaction 3 below, to form additional hydrogen. As such, injecting the primary fluid 80 can enhance hydrogen recovery and improve yield of the product gas 55. In some embodiments, the carbon dioxide does not act as a reactant for the gasification reactions occurring within the UCG reaction region 70.

$$CO_2(g)+C(s)\rightarrow 2CO(g) \quad \text{(Reaction 2)}$$

$$CO(g)+H_2O(g)\rightarrow CO_2(g)+H_2(g) \quad \text{(Reaction 3)}$$

As another example of how the type of primary fluid 80 injected into the coal seam 10 can affect certain characteristics of the primary region 65, in those embodiments for which the primary fluid 80 comprises supercritical carbon dioxide, the adsorption of carbon dioxide by the coal matrix of the coal seam 10 can be enhanced relative to using non-supercritical carbon dioxide as the primary fluid 80, and the resultant pressure ($P_2$) of the corresponding primary region 65 can be relatively higher. Using a supercritical fluid as the primary fluid 80 can be particularly beneficial when working at extreme depths, e.g., to ensure the pressure ($P_2$) of the primary region 65 is greater than the hydrostatic pressure ($P_1$) of the coal seam 10, and thus creates the pressure gradient, as described elsewhere herein, to establish containment of the oxidant 15, product gas 55, and other gases present within the UCG reaction region 70 and generally increase yield of product gas 55 extracted via the production well 45.

As another example of how the type of primary fluid 80 injected into the coal seam 10 can affect certain characteristics of the primary region 65, in those embodiments for which the primary fluid 80 comprises water, injecting the primary fluid 80 can cause the coal matrix surrounding or at least partially surrounding the UCG reaction region 70 to become saturated or partially saturated with water. Without being bound by theory, the injected water of the primary fluid 80 is expected to occupy the pore space and/or the fractures of the coal seam (e.g., between individual coal particles), and wets the coal to form forces (e.g., surface tension) that maintain the water in the pore space and/or fractures. As a result, the pore space of the coal matrix is decreased relative to that of a coal matrix of an untreated coal seam, and creates the impermeable barrier or jacket described elsewhere herein to inhibit the oxidant 15, product gas 55, and other gases present within the UCG reaction region 70 from migrating to areas peripheral to the primary region 65. Additionally or alternatively, the water vapor formed as the primary fluid 80 enters the UCG reaction region 70 can act as a reactant for the gasification reaction (Reaction 1) and the water-gas shift reaction (Reaction 3) occurring within the UCG reaction region 70. Accordingly, injecting water as part of the primary fluid 80 can improve the yield of the product gas 55 and/or enhance hydrogen recovery.

In some embodiments, injecting the primary fluid 80 into the coal seam 10 can cause a secondary region 77 to form that is (i) peripheral to and/or partially surrounding the UCG reaction region 70, and (ii) at least partially surrounded by the primary region 65. As previously described, the higher affinity of the coal of the coal seam 10 for the primary fluid 80 can displace and/or cause the coal to release, other fluids present in the coal seam 10. This can occur in conjunction with the swelling of the coal of the coal seam 10, as previously described. For example, carbon dioxide of the primary fluid 80 injected into the coal seam 10 can attach or adsorb to the corresponding coal of the coal seam 10 and cause the coal to displace a secondary fluid 75 that the coal has a lower affinity for. The secondary fluid 75 can comprise water, methane, other hydrocarbons, and/or combinations thereof. The pressure of the secondary region 77 can be similar to the pressure ($P_1$) of the primary region, which can correspond to the injection pressure of the primary fluid 80. As such, the decreasing pressure differential in the direction from the primary region 65 toward the UCG reaction region 70 can drive the secondary fluid 75 toward the UCG reaction region 70. The secondary fluid 75 can act as a reactant to further promote the coal gasification reactions (e.g., Reactions 1 and 3) occurring within the UCG reaction region 70. As a result, releasing the secondary fluid 75, produced as a result of injecting the primary fluid 80 peripheral to the UCG reaction region 70, can further promote the coal gasification reactions and thereby improve the yield of the product gas 55 and/or enhance hydrogen recovery. In some embodiments, the amount of secondary fluid generated is controlled by the injection pressure of the primary fluid 80. Moreover, as the secondary fluid can affect the composition of the product gas 55, in some embodiments controlling the primary fluid 80 (e.g., the composition, the injection pressure, etc.) can be used to adjust the yield and/or composition of the product gas 55.

An example test was conducted that corresponds to embodiments of the present technology. In the test, an air-blown UCG reactor was established in a coal seam at a depth of 225 meters that was saturated with groundwater. The hydrostatic pressure of the coal seam was approximately 1,550 kilopascals (kPa). The UCG reactor operated for 45 days with stable injection and production flow rates under a pressure of 700 kPa. The product gas contained approximately 15% hydrogen and 4.5% methane. Water was injected into the coal seam in the vicinity of the UCG reactor at the rate of 1.5 tons per hour at a pressure of 2,850 kPa on day 46, and continued under steady conditions for 10 days. The UCG reactor pressure during this period remained unchanged. On day 49, hydrogen and methane content of the product gas increased and remained elevated until day 61, with average concentrations of 21% hydrogen and 6.5% methane. During the same period (day 49 to day 61), the average dry product gas flow rate increased by 3.5%.

Figure 4:
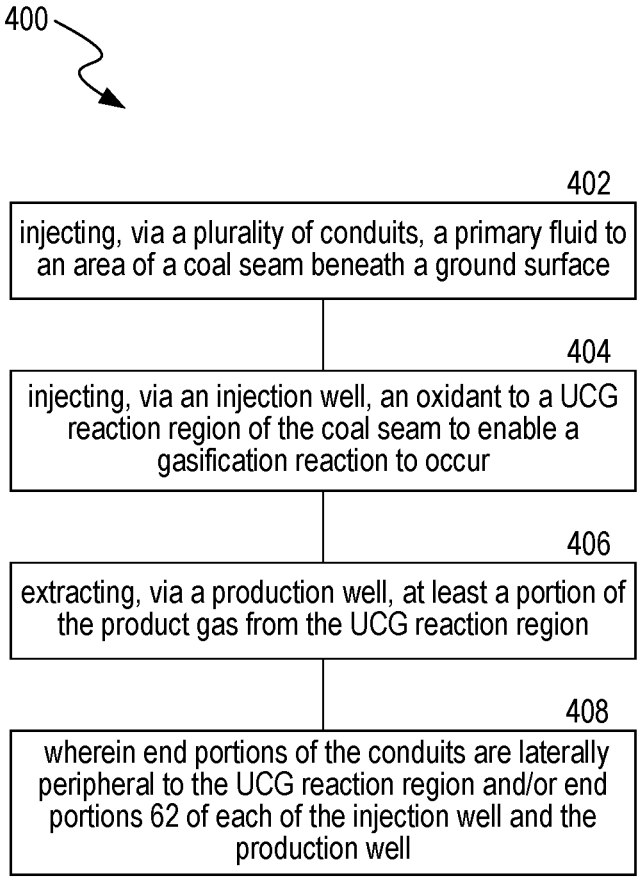
FIG. 4 is a block flow diagram of a method for gasifying coal, in accordance with embodiments of the present technology.

FIG. 4 is a block flow diagram of a method 400 for gasifying coal, in accordance with embodiments of the present technology. The method 400 can comprise injecting, via a plurality of conduits (e.g., the conduits 62), a primary fluid (e.g., the primary fluid 80) to an area of a coal seam (e.g., the coal seam 10) beneath a ground surface (e.g., the ground surface 50) (process portion 402). Injecting the primary fluid can occur at a pressure of at least 100 bar, 110 bar, 120 bar, 130 bar, 140 bar, 150 bar, or 160 bar.

The method 400 can further comprise injecting, via an injection well (e.g., the injection well 20), an oxidant (e.g., the oxidant 15) to a UCG reaction region (e.g., the UCG reaction region 70) of the coal seam to support or enable a gasification reaction to occur (process portion 404). The gasification reaction can include one or more of Reactions 1, 2, or 3 described herein, and can produce a product gas (e.g., the product gas 55) comprising at least two of hydrogen, carbon monoxide, or carbon dioxide. In some embodiments, injecting the primary fluid occurs before injecting the oxidant gas, e.g., to allow sufficient time for the primary fluid to saturate an area at least partially surrounding the UCG reaction region and thereby form a barrier zone (e.g., the primary region 65). In some embodiments, injecting the primary fluid occurs concurrently to injecting the oxidant gas.

The method 400 can further comprise extracting, via a production well (e.g., the production well 45), at least a portion of the product gas from the UCG reaction region (process portion 406). In some embodiments, extracting the product gas can include monitoring the product gas (e.g., continuously or intermittently) to measure the composition and/or quality of the product gas and determine whether adjustments need to be made. For example, if the extracted product gas indicates that quality, purity, and/or yield is deteriorating over time, the process can include making adjustments to the injection of the primary fluid. For example, the primary fluid injection pressure, amount of injected primary fluid, and/or composition of the primary fluid can each be adjusted and affect the product gas.

The method 400 can further comprise, wherein end portions (e.g., the conduit end portions 62) of the conduits are laterally peripheral to the UCG reaction region 70 and/or end portions 62 of each of the injection well and the production well (process portion 408). Disposing the end portions of the conduits laterally peripheral to the UCG reaction region can form a pressure profile configured to at least partially surround the UCG reaction region and/or contain the oxidant and product gas within the UCG reaction region.

III. Conclusion

It will be apparent to those having skill in the art that changes may be made to the details of the above-described embodiments without departing from the underlying principles of the present disclosure. In some cases, well known structures and functions have not been shown or described in detail to avoid unnecessarily obscuring the description of the embodiments of the present technology. Although steps of methods may be presented herein in a particular order, other embodiments may perform the steps in a different order. For example, injecting the primary fluid can occur before, after, or concurrent with injecting the oxidant gas. Similarly, certain aspects of the present technology disclosed in the context of particular embodiments can be combined or eliminated in other embodiments. Furthermore, while advantages associated with certain embodiments of the present technology may have been disclosed in the context of those embodiments, other embodiments can also exhibit such advantages, and not all embodiments need necessarily exhibit such advantages or other advantages disclosed herein to fall within the scope of the technology. Accordingly, the disclosure and associated technology can encompass other embodiments not expressly shown or described herein, and the invention is not limited except as by the appended claims.

Throughout this disclosure, the singular terms "a," "an," and "the" include plural referents unless the context clearly indicates otherwise. The term "and/or" when used in reference to a list of two or more item is to be interpreted as including (a) any single item in the list, (b) all of the items in the list, or (c) any combination of the items in the list. Additionally, the term "comprising," "including," and "having" should be interpreted to mean including at least the recited feature(s) such that any greater number of the same feature and/or additional types of other features are not precluded.

Reference herein to "one embodiment," "an embodiment," "some embodiments" or similar formulations means that a particular feature, structure, operation, or characteristic described in connection with the embodiment can be included in at least one embodiment of the present technology. Thus, the appearances of such phrases or formulations herein are not necessarily all referring to the same embodiment. Furthermore, various particular features, structures, operations, or characteristics may be combined in any suitable manner in one or more embodiments.

Unless otherwise indicated, all numbers expressing numerical values (e.g., pressures, temperatures, etc.) used in the specification and claims, are to be understood as being modified in all instances by the term "about" or "approximately." The terms "about" or "approximately," when used in reference to a value, are to be interpreted to mean within 10% of the stated value. Accordingly, unless indicated to the contrary, the numerical parameters set forth in the following specification and attached claims are approximations that may vary depending upon the desired properties sought to be obtained by the present technology. At the very least, and not as an attempt to limit the application of the doctrine of equivalents to the scope of the claims, each numerical parameter should at least be construed in light of the number of reported significant digits and by applying ordinary rounding techniques. Additionally, all ranges disclosed herein are to be understood to encompass any and all subranges subsumed therein. For example, a range of "1 to 10" includes any and all subranges between (and including) the minimum value of 1 and the maximum value of 10, i.e., any and all subranges having a minimum value of equal to or greater than 1 and a maximum value of equal to or less than 10, e.g., 5.5 to 10.

The disclosure set forth above is not to be interpreted as reflecting an intention that any claim requires more features than those expressly recited in that claim. Rather, as the following claims reflect, inventive aspects lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

The present technology is illustrated, for example, according to various aspects described below. Various examples of aspects of the present technology are described as numbered examples (1, 2, 3, etc.) for convenience. These are provided as examples and do not limit the present technology. It is noted that any of the dependent examples may be combined in any combination, and placed into a respective independent example. The other examples can be presented in a similar manner.

1. A method of gasifying coal, the method comprising:
   injecting, via a plurality of fluid wells, a primary fluid to an area of a coal seam beneath a ground surface, wherein injecting the primary fluid causes a primary region to form within the coal seam;

injecting, via an injection well, an oxidant gas to an underground coal gasification (UCG) reaction region of the coal seam, to support a gasification reaction in which a product gas comprising at least two of hydrogen, carbon monoxide, carbon dioxide or methane is produced, the UCG reaction region being at least partially surrounded by the primary region; and extracting, via a production well, at least a portion of the product gas from the UCG reaction region.

2. The method of any one of the clauses herein, wherein end portions of the fluid wells are disposed within the coal seam and are each laterally peripheral to end portions of each of the injection well and the production well.

3. The method of any one of the clauses herein, wherein end portions of the fluid wells define a perimeter at least partially surrounding the injection well and the production well.

4. The method of any one of the clauses herein, wherein the fluid wells are disposed around and/or peripheral to the injection well and the production well.

5. The method of any one of the clauses herein, wherein injecting the primary fluid occurs prior to injecting the oxidant gas.

6. The method of any one of the clauses herein, wherein injecting the primary fluid occurs in conjunction with injecting the oxidant gas.

7. The method of any one of the clauses herein, wherein injecting the primary fluid inhibits the oxidant gas and/or the product gas from migrating from the UCG reaction region to an area of the coal seam peripheral to the primary region.

8. The method of any one of the clauses herein, wherein injecting the primary fluid comprises injecting the primary fluid at a first operating pressure greater than a hydrostatic reservoir pressure of the coal seam, and wherein injecting the oxidant comprises injecting the oxidant at a second operating pressure less than each of the first operating pressure and the hydrostatic reservoir pressure.

9. The method of any one of the clauses herein, wherein injecting the primary fluid comprises injecting the primary fluid such that the primary region operates at a first operating pressure higher than a hydrostatic reservoir pressure of the coal seam, and wherein injecting the oxidant gas comprises injecting the oxidant gas such that the UCG reaction region operates at a second operating pressure lower than each of the first operating pressure and the hydrostatic reservoir pressure.

10. The method of any one of the clauses herein, wherein injecting the primary fluid comprises injecting the primary fluid at an operating pressure of at least 100 bar, 110 bar, 120 bar, 130 bar, 140 bar, 150 bar, or 160 bar.

11. The method of any one of the clauses herein, wherein injecting the oxidant comprises injecting the oxidant at a second operating pressure of no more than 50 bar, 60 bar, 70 bar, or 80 bar.

12. The UCG system of any one of the clauses herein, wherein the primary region entirely surrounds the UCG reaction region.

13. The method of any one of the clauses herein, wherein the coal seam comprises coal, and wherein injecting the primary fluid via the fluid wells causes the coal of the coal seam to release at least one of methane or water and form a secondary region, the secondary region at least partially surrounding the UCG reaction region and being at least partially surrounded by the primary region.

14. The method of any one of the clauses herein, wherein the coal seam comprises coal, and wherein injecting the primary fluid via the fluid wells causes the coal within the primary region of the coal seam to swell or increase in size.

15. The method of any one of the clauses herein, wherein injecting the primary fluid via the fluid wells causes a secondary region to form between the UCG reaction region and the primary region, the secondary region comprising coal, methane, and water.

16. The method of any one of the clauses herein, wherein injecting the primary fluid via the fluid wells causes a secondary region to form, the secondary region encircling the UCG reaction region and the primary region encircling the secondary region.

17. The method of any one of the clauses herein, wherein injecting the primary fluid via the fluid wells causes a secondary region to form between the primary region and the UCG reaction region, wherein the UCG reaction region operates at a first pressure, the secondary region operates at a second pressure higher than the first pressure, and the primary region operates at a third pressure higher than the second pressure.

18. The method of any one of the clauses herein, wherein the primary fluid comprises a carbon dioxide concentration of at least 50%, 60%, 70%, 80%, or 90%.

19. The method of any one of the clauses herein, wherein the primary fluid comprises a supercritical fluid.

20. The method of any one of the clauses herein, wherein the primary fluid comprises carbon dioxide, and wherein the primary region has a carbon dioxide concentration of at least 5%, 10%, 15%, 20%, or 25% by weight.

21. The method of any one of the clauses herein, wherein the primary fluid comprises carbon dioxide, and wherein injecting the primary fluid comprising carbon dioxide forms a sequestration cap at the primary region around the UCG reaction region.

22. The method of any one of the clauses herein, wherein the primary fluid comprises water, and wherein the open fracture space and/or pore volume of the primary region has a water concentration of at least 50%, 60%, 70%, 80%, or 90% by volume.

23. The method of any one of the clauses herein, wherein the primary fluid is water, and wherein injecting water via the fluid wells causes methane to be displaced from the primary region toward the UCG reaction region.

24. The method of any one of the clauses herein, wherein the primary fluid comprises water, and wherein injecting water via the fluid wells causes the concentration of hydrogen and/or carbon monoxide of the product gas to increase.

25. The method of any one of the clauses herein, wherein an untreated area of the coal seam has a first pore space, and wherein the primary region has a second pore space less than the first pore space.

26. The method of any one of the clauses herein, wherein injecting the primary fluid causes the primary fluid to occupy at least a portion of a pore space of the coal seam.

27. The method of any one of the clauses herein, wherein the primary region is saturated with the primary fluid.

28. The method of any one of the clauses herein, wherein the oxidant gas comprises at least 50%, 60%, 70%, 80%, or 90% oxygen.

29. The method of any one of the clauses herein, wherein the oxidant gas comprises oxygen and water.

30. The method of any one of the clauses herein, wherein the fluid wells comprise at least three, four, five, six, seven, eight, nine, or 10 fluid wells.

31. The method of any one of the clauses herein, wherein end portions of the fluid wells are positioned within the coal seam and form a generally circular, ovular, rectangular, or polygonal shape.

32. The method of any one of the clauses herein, wherein the injection well is one of a plurality of wells and/or the production well is one of a plurality of production wells.

33. A method of gasifying coal, the method comprising:

injecting, via a plurality of fluid wells, a primary fluid to an area of a coal seam beneath a ground surface;

injecting, via an injection well, an oxidant gas to an underground coal gasification (UCG) reaction region of the coal seam, to support a gasification reaction in which a product gas comprising at least two of hydrogen, carbon monoxide, or carbon dioxide is produced; and extracting, via a production well, at least a portion of the product gas from the UCG reaction region, wherein end portions of the fluid wells are laterally peripheral to the UCG reaction region and end portions of each of the injection well and production well.

34. The method of any one of the clauses herein, wherein injecting the primary fluid forms a primary region within the coal seam, and wherein the UCG reaction area is at least partially surrounded by the primary region.

35. The method of any one of the clauses herein, wherein the end portions of the fluid wells define a perimeter generally surrounding the injection well and the production well.

36. The method of any one of the clauses herein, wherein injecting the primary fluid occurs prior to injecting the oxidant gas.

37. The method of any one of the clauses herein, wherein injecting the primary fluid occurs in conjunction with injecting the oxidant gas.

38. The method of any one of the previous clauses, wherein injecting the primary fluid inhibits the oxidant gas and/or the product gas from migrating from the UCG reaction region to an area of the coal seam peripheral to a perimeter defined by the end portions of the fluid wells.

39. The method of any one of the previous clauses, wherein injecting the primary fluid comprises injecting the primary fluid at a first operating pressure greater than a hydrostatic reservoir pressure of the coal seam, and wherein injecting the oxidant comprises injecting the oxidant at a second operating pressure less than each of the first operating pressure and the hydrostatic reservoir pressure.

40. The method of any one of the previous clauses, wherein injecting the primary fluid comprises injecting the primary fluid at an operating pressure of at least 100 bar, 110 bar, 120 bar, 130 bar, 140 bar, 150 bar, or 160 bar.

41. The method of any one of the previous clauses, wherein injecting the oxidant comprises injecting the oxidant at a second operating pressure of no more than 50 bar, 60 bar, 70 bar, or 80 bar.

42. The method of any one of the clauses herein, wherein:

the coal seam comprises coal, injecting the primary fluid via the fluid wells forms a primary region at least partially surrounding the UCG reaction region, and causes the coal of the coal seam to release at least one of methane or water and form a secondary region, and the secondary region at least partially surrounds the UCG reaction region and is at least partially surrounded by the primary region.

43. The method of any one of the clauses herein, wherein the coal seam comprises coal, and wherein injecting the primary fluid via the fluid wells causes the coal of the coal seam to swell.

44. The method of any one of the clauses herein, wherein the primary fluid comprises a carbon dioxide concentration of at least 50%, 60%, 70%, 80%, or 90%.

45. The method of any one of the clauses herein, wherein the primary fluid comprises a supercritical fluid.

46. The method of any one of the clauses herein, wherein the primary fluid comprises carbon dioxide, and wherein injecting the primary fluid comprising carbon dioxide forms a sequestration cap to form around the UCG reaction region.

47. The method of any one of the clauses herein, wherein the primary fluid is water, and wherein injecting water via the fluid wells causes methane to be displaced from coal of the coal seam in a direction toward the UCG reaction region.

48. The method of any one of the clauses herein, wherein the primary fluid comprises water, and wherein injecting water via the fluid wells causes the concentration of hydrogen and/or carbon monoxide of the product gas to increase.

49. The method of any one of the clauses herein, wherein an untreated area of the coal seam has a first pore space, and wherein injecting the primarily fluid causes a corresponding region of the coal seam to have a second pore space less than the first pore space.

50. The method of any one of the clauses herein, wherein injecting the primary fluid causes the primary fluid to occupy at least a portion of a pore space of the coal seam.

51. The method of any one of the clauses herein, wherein injecting the primary fluid causes a corresponding region of the coal seam to be generally saturated with the primary fluid.

52. The method of any one of the clauses herein, wherein the oxidant gas comprises at least 50%, 60%, 70%, 80%, or 90% oxygen.

53. The method of any one of the clauses herein, wherein the oxidant gas comprises oxygen and water.

54. The method of any one of the clauses herein, wherein the fluid wells comprise at least three, four, five, six, seven, eight, nine, or 10 fluid wells.

55. The method of any one of the clauses herein, wherein end portions of the fluid wells are positioned within the coal seam and form a generally circular, ovular, rectangular, or polygonal shape.

56. The method of any one of the clauses herein, wherein the injection well is one of a plurality of wells and/or the production well is one of a plurality of production wells.

57. An underground coal gasification (UCG) system, comprising:

an injection well extending from a ground surface to an underground coal gasification (UCG) reaction region of a coal seam, wherein the UCG reaction region is positioned to produce a product gas in the presence of oxygen via a gasification reaction, and wherein the injection well is positioned to deliver an oxidant gas from the ground surface to the coal seam;

a production well spaced apart from the injection well and extending from the ground surface to the UCG reaction region, the production well being positioned to deliver the product gas from the UCG reaction region to the ground surface; and fluid wells each extending from the ground surface to areas of the coal seam that are outward of the UCG reaction region, the fluid wells being positioned to deliver a primary fluid from the ground surface to the primary region.

58. The UCG system of any one of the clauses herein, wherein end portions of the fluid wells are disposed within the coal seam and laterally peripheral to end portions of the injection well and the production well.

59. The UCG system of any one of the clauses herein, wherein end portions of the fluid wells are disposed within the coal seam and peripheral to end portions of the injection well and the production well, and wherein the end portions of the fluid wells define a perimeter that at least partially surrounds the UCG reaction area.

60. The UCG system of any one of the clauses herein, wherein, in operation, the primary fluid delivered to the areas of the coal seam at least in part defines a primary region at least partially surrounding the UCG reaction region, the primary region having a higher concentration of the primary fluid than that of the UCG reaction region.

61. The UCG system of any one of the clauses herein, wherein, in operation, the primary fluid delivered to the areas of the coal seam defines at least in part a primary region at least partially surrounding the UCG reaction region, the primary region having a higher concentration of the primary fluid than that of an area of the coal seam laterally peripheral to the primary region.

62. The UCG system of any one of the clauses herein, wherein, in operation, the primary fluid delivered to the areas of the coal seam defines at least in part a primary region that inhibits (i) the oxidant gas delivered to the UCG reaction region and/or (ii) the product gas produced via the UCG reaction region from migrating to areas of the coal seam laterally beyond the primary region.

63. The UCG system of any one of the clauses herein, wherein, in operation, the primary fluid delivered to the areas of the coal seam defines at least in part a primary region, and wherein the primary region has a first operating pressure higher than a hydrostatic reservoir pressure of the coal seam, and the UCG reaction region has a second operating pressure less than the first operating pressure and less than the hydrostatic reservoir pressure.

64. The UCG system of any one of the clauses herein, wherein, in operation, the primary fluid delivered to the areas of the coal seam defines at least in part a primary region, and wherein the primary region has a first operating pressure of at least 100 bar, 110 bar, 120 bar, 130 bar, 140 bar, 150 bar, or 160 bar, and the UCG reaction region has a second operating pressure of no more than 50 bar, 60 bar, 70 bar, or 80 bar.

65. The UCG system of any one of the clauses herein, wherein, in operation, (i) the primary fluid delivered to the areas of the coal seam defines at least in part a primary region, and (ii) delivery of the primary fluid via the fluid wells causes methane and/or water to be released from an adjacent area of the coal seam and form a secondary region, wherein the secondary region at least partially surrounds the UCG reaction region and the primary region at least partially surrounds the secondary region.

66. The UCG system of any one of the clauses herein, wherein, in operation, (i) the primary fluid delivered to the areas of the coal seam defines at least in part a primary region, and (ii) delivery of the primary fluid via the fluid wells causes methane and/or water to be released from an adjacent area of the coal seam and form a secondary region, wherein the UCG reaction region operates at a first pressure, the secondary region operates at a second pressure higher than the first pressure, and the primary region operates at a third pressure higher than the second pressure.

67. The UCG system of any one of the clauses herein, wherein the primary fluid comprises a concentration of carbon dioxide of at least 50%, 60%, 70%, 80%, or 90%.

68. The UCG system of any one of the clauses herein, wherein the primary fluid comprises supercritical fluid.

69. The UCG system of any one of the clauses herein, wherein the primary fluid is carbon dioxide and/or water.

70. The UCG system of any one of the clauses herein, wherein the primary fluid is not a reactant of the gasification reaction or any other reaction occurring within the UCG reaction region.

71. The UCG system of any one of the clauses herein, wherein the oxidant comprises at least 50%, 60%, 70%, 80%, or 90% oxygen.

72. The UCG system of any one of the clauses herein, wherein the oxidant comprises oxygen and water.

73. The UCG system of any one of the clauses herein, wherein the product gas is synthesis gas comprising hydrogen, carbon monoxide, carbon dioxide, and methane.

74. The UCG system of any one of the clauses herein, wherein, the fluid wells comprise at least three, four, five, six, seven, eight, nine, or 10 fluid wells.

75. The UCG system of any one of the clauses herein, wherein, the fluid wells comprise a plurality of fluid wells, and wherein end portions of the fluid wells are positioned within the coal seam and form a generally circular, ovular, rectangular, or polygonal shape.

76. The UCG system of any one of the clauses herein, wherein the injection well is one of a plurality of wells and/or the production well is one of a plurality of production wells.

77. A method for extracting a product gas from an underground coal seam, the method comprising:

injecting a primary fluid from a primary fluid source via a plurality of primary fluid wells into a plurality of fluid injection locations in the coal seam, the primary fluid injected into the plurality of fluid injection locations under a primary fluid pressure, each of the plurality of primary fluid wells extending from the primary fluid source to one of the plurality of fluid injection locations, wherein the plurality of fluid injection locations are disposed generally around a periphery of an underground coal gasification ("UCG") reactor, the UCG reactor comprising a reaction region and a production region of the coal seam, thereby causing injected primary fluid to saturate coal disposed proximate to the plurality of fluid injection locations, thereby forming a barrier zone generally around the UCG reactor, wherein the barrier zone facilitates containment of gases and fluids within the UCG reactor;

injecting an oxidant into the reaction region of the coal seam, via an injection well extending from the surface to the reaction region, wherein the oxidant comprises oxygen or air, and wherein the oxidant is injected into the reaction region;

causing the oxidant and coal in the reaction region of the coal seam to undergo, in the presence of water or steam, an in-situ gasification reaction to produce the product gas, following which the product gas flows from the reaction region to the production region of the coal seam; and extracting the product gas via a production well extending from the production region of the coal seam to the surface, wherein the product gas is syngas.

78. The method of clause 77, wherein the primary fluid is one or more of supercritical carbon dioxide or water.

79. The method of any one of clauses 77 or 78, additionally comprising injecting steam or water into the reaction region, via the injection well.

80. The method of any one of clauses 77 to 79, wherein injecting the primary fluid into the plurality of fluid injection locations in the coal seam, causes methane and water adsorbed within the coal seam to be displaced as a secondary fluid into the UCG reactor, and wherein the secondary fluid facilitates the gasification reaction.

81. The method of any one of clauses 77 to 80, wherein the primary fluid pressure is maintained higher than both a reactor pressure in the UCG reactor and a reservoir pressure, the reservoir pressure being hydrostatic pressure in the coal seam surrounding the barrier zone, in order to create a pressure gradient, thereby inhibiting the oxidant and the product gas from flowing out of the UCG reactor.

82. The method of clauses 81 wherein the primary fluid pressure is maintained higher than both a reactor pressure in the UCG reactor and a reservoir pressure, the reservoir pressure being the hydrostatic pressure in the coal seam surrounding the barrier zone, in order to create a pressure gradient, thereby inhibiting the oxidant, the product gas and the secondary fluid from flowing out of the UCG reactor.

83. The method of clause 81 or 82, wherein the primary fluid pressure is regulated to control a flow rate of primary fluid and secondary fluid into the UCG reactor.

84. The method of clauses 81, wherein a reactor pressure in the UCG reactor is controlled, such that a positive pressure differential between a reservoir pressure and the reactor pressure is maintained in order to drive a flow of secondary fluid into the UCG reactor, the reservoir pressure being the pressure in the coal seam surrounding the barrier zone.

85. The method of any one of clauses 81 to 84, additionally comprising:

monitoring a measured composition of the product gas extracted from the production well; and regulating the steps of injecting the primary fluid in response to the measured composition of the product gas, in order to improve a yield or quality of the product gas produced in the in-situ gasification reaction.

86. The method of clause 81, wherein the primary fluid pressure is regulated in order to control displacement of secondary fluid from the coal seam and a flow rate of secondary fluid into the UCG reactor.

87. The method of clause 81, wherein the primary fluid pressure and a reactor pressure in the UCG reactor are controlled in order to create a pressure gradient, thereby directing the secondary fluid to flow in a direction towards the UCG reactor.

88. A system for extracting a product gas from an underground coal seam, the system comprising:

an underground coal gasification system; and a plurality of fluid wells;

wherein the underground coal gasification system comprises:

an injection well, extending from a ground surface to a reaction region of the coal seam, the injection well positioned to inject an oxidant comprising oxygen and/or air into the reaction region, thereby causing the oxidant and coal in the reaction region to undergo, in the presence of water or steam, an in-situ gasification reaction to produce a product gas, wherein the product gas is syngas, following which the product gas flows from the reaction region to a production region of the coal seam; and a production well, extending from the production region to the ground surface, positioned to extract the product gas;

and wherein each of the plurality of fluid wells extends from a primary fluid source to one of a plurality of fluid injection locations in the coal seam, wherein the plurality of fluid injection locations are disposed generally around a periphery of an underground coal gasification ("UCG") reactor, the UCG reactor comprising the reaction region and the production region of the coal seam, wherein the plurality of fluid wells are positioned to inject a primary fluid from the primary fluid source into the plurality of fluid injection locations, to saturate coal disposed proximate to the plurality of fluid injection locations, and form a barrier zone generally surrounding the UCG reactor, wherein the barrier zone facilitates containment of gases and fluids within the UCG reactor during the in-situ gasification reaction.

89. The system of clause 88, wherein the primary fluid is supercritical carbon dioxide or water.

We claim:

1. An underground injection system, comprising:

one or more injection wells extending to an underground region supporting a reaction in which a product gas comprising hydrogen is produced, wherein the one or more injection wells are positioned to deliver an oxidant to the underground region;

conduits each extending to an area laterally outward of the underground region, the area comprising coal, the conduits including a first conduit laterally outward from a first side of the underground region and a second conduit laterally outward from a second side of the underground region different than the first side; and a primary fluid comprising carbon dioxide, the conduits being positioned to deliver the primary fluid toward the area laterally outward of the underground region, wherein, in operation, the carbon dioxide of the delivered primary fluid adsorbs to the coal of the area.

2. The system of claim 1, wherein the primary fluid comprises water.

3. The system of claim 1, wherein the primary fluid comprises a supercritical fluid.

4. The system of claim 1, wherein the underground region comprises an underground coal gasification (UCG) reaction region.

5. The system of claim 1, wherein the conduits define a perimeter at least partially surrounding the underground region.

6. The system of claim 1, further comprising a production well spaced apart from the injection well and extending from the underground region.

7. An underground injection system, comprising:

an injection well extending to an underground region, the injection well being configured to direct an oxidant to the underground region;

a production well extending from the underground region toward a surface, the production well being configured to direct a product gas from the underground region toward the surface; and conduits extending to underground areas comprising coal, wherein the underground areas are laterally outward of the underground region such that the conduits at least partially surround the underground region, the conduits being coupled to a source of carbon dioxide and configured to direct a primary fluid comprising the carbon dioxide to the underground areas, wherein, in operation, the primary fluid causes the coal of the underground areas to release at least one of water or methane.

8. The system of claim 7, wherein the primary fluid comprises a supercritical fluid.

9. The system of claim 7, wherein the primary fluid comprises water.

10. The system of claim 7, wherein the underground region comprises an underground coal gasification (UCG) reaction region, and wherein the surface is a ground surface.

11. The system of claim 7, wherein the conduits comprise corresponding end portions that define a perimeter surrounding the underground region.

12. The system of claim 7, wherein the conduits comprise a first conduit having a first end portion and a second conduit having a second end portion, the first end portion being on a first side of the underground region and the second end portion being on a second side of the underground region opposite or different from the first side.

13. An enhanced hydrogen recovery system, comprising:

conduits extending to an area laterally outward of an underground region, wherein the underground region supports a process in which a product gas comprising hydrogen is produced;

a primary fluid comprising carbon dioxide, wherein the conduits are configured to direct the primary fluid to the area; and one or more production wells each spaced apart from each of the conduits and extending from the underground region, the production well being positioned to deliver the product gas from the underground region, wherein, in operation, the primary fluid decreases a pore space of the area laterally outward of the underground region.

14. The system of claim 13, wherein the primary fluid comprises a supercritical fluid.

15. The system of claim 13, wherein the primary fluid comprises water.

16. The system of claim 13, wherein the conduits comprise corresponding end portions that define a perimeter at least partially surrounding the underground region.

17. The system of claim 13, wherein the conduits comprise a first conduit having a first end portion and a second conduit having a second end portion, the first end portion being on a first side of the reaction region and the second end portion being on a second side of the underground region opposite or different from the first side.

18. The system of claim 13, further comprising one or more injection wells extending to the underground region and positioned to deliver an oxidant to the underground region.

19. The system of claim 18, wherein, in operation— the primary fluid is configured to form a primary region at the underground area that at least partially surrounds the underground region, and the primary region inhibits the oxidant and/or the product gas from migrating from the underground region to an area laterally outward of the primary region.

20. A method for recovering and/or producing hydrogen from an underground primary region, the method comprising:

causing a primary fluid comprising carbon dioxide to be injected via conduits to an underground secondary area, the secondary area being laterally outward of the primary region and comprising a matrix, wherein the injected carbon dioxide causes the matrix of the secondary area to swell, decrease a pore space of the secondary area, and inhibit the spread of fluid, in the primary region, laterally outward of the secondary area.

21. The method of claim 20, wherein the injected carbon dioxide causes the matrix to form a barrier around the primary region.

22. The method of claim 20, wherein the injected carbon dioxide causes the matrix to form a sequestration cap around the primary region.

23. The method of claim 20, wherein the injected carbon dioxide adsorbs to the matrix of the secondary area.

24. The method of claim 20, wherein the injected carbon dioxide causes a secondary fluid to be released from the secondary area, the secondary fluid comprising at least one of water or methane.

25. The method of claim 20, wherein the primary fluid comprises carbon dioxide and water, and wherein the injected water causes the secondary area to become at least partially saturated with the water.

26. The method of claim 20, wherein the matrix has a reservoir pressure, and wherein causing the primary fluid to be injected comprises causing the primary fluid to be injected at an operating pressure higher than the reservoir pressure.

27. The method of claim 26, wherein the operating pressure is at least 150 bar.

28. The method of claim 20, further comprising:

causing an oxidant to be injected via an injection well to the primary region; and causing a product comprising hydrogen to be extracted via a production well from the primary region.

* * * * *